US007563206B1

(12) United States Patent
Bellerive

(10) Patent No.: US 7,563,206 B1
(45) Date of Patent: Jul. 21, 2009

(54) SWIMMING EXERCISING DEVICE

(76) Inventor: Donald Bellerive, 10711 Deer Run Farms Rd., Fort Myers, FL (US) 33966

( * ) Notice: Subject to any disclaimer, the term of this patent is extended or adjusted under 35 U.S.C. 154(b) by 0 days.

(21) Appl. No.: 12/008,314

(22) Filed: Jan. 10, 2008

(51) Int. Cl.
*A63B 31/00* (2006.01)

(52) U.S. Cl. ..... 482/55; 434/254

(58) Field of Classification Search ..... 482/55, 482/56; 434/254; 43/21.2; 403/292, 296; 248/518, 535, 538
See application file for complete search history.

(56) References Cited

U.S. PATENT DOCUMENTS 4,486,016 A * 12/1984 Rubin ..... 482/90
4,530,497 A * 7/1985 Moran et al. ..... 482/55
6,796,608 B2 * 9/2004 Ventimiglia et al. ..... 297/217.1
6,898,893 B1 * 5/2005 Mukdaprakorn ..... 43/21.2
7,442,151 B1 * 10/2008 Berdegue ..... 482/55
2006/0054772 A1 * 3/2006 Priscott et al. ..... 248/558

* cited by examiner

*Primary Examiner*—Loan H Thanh
*Assistant Examiner*—Tam Nguyen

(57) ABSTRACT

Individual swimmers may routinely and easily perform exercise regiments to maintain or enhance their general health and fitness utilizing the present invention. Segmented poles may be readily shipped, or otherwise transported, in a disassembled state and assembled easily and quickly to full length for use with the overall swimming exercise device. Numerous pole mounting arrangements provide for deployment of the swimming exercise device with nearly any configuration of swimming pool without regard for whether the pool is of the in ground style or of the above ground style and without regard for size from the smallest available to Olympic size. A small but durable hand rail mount provides for the swimmer to perform their respective workout when traveling or otherwise visiting another pool without requiring any structural modification to the pool to be used and without any concern for damage occurring to the pool to be used.

8 Claims, 16 Drawing Sheets

FIG. 10a
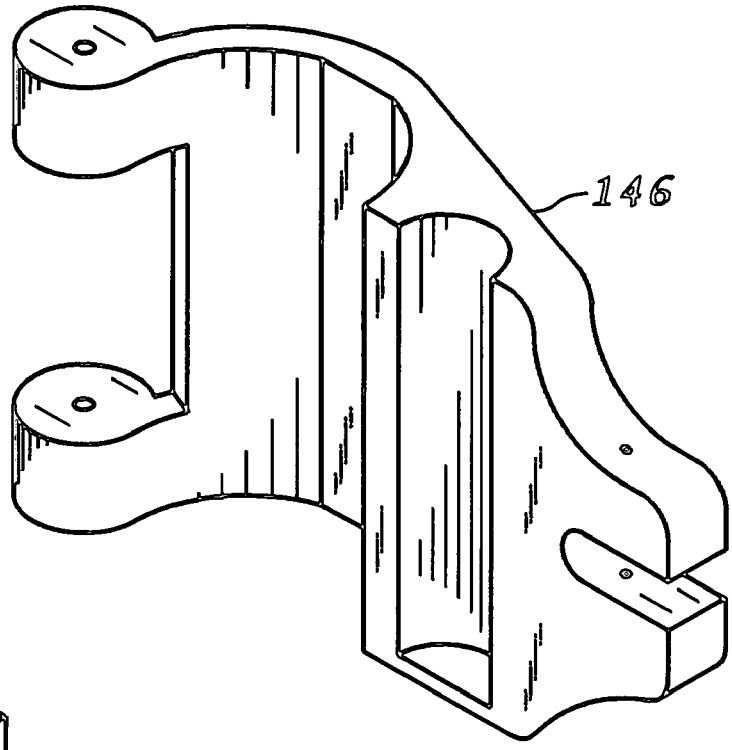
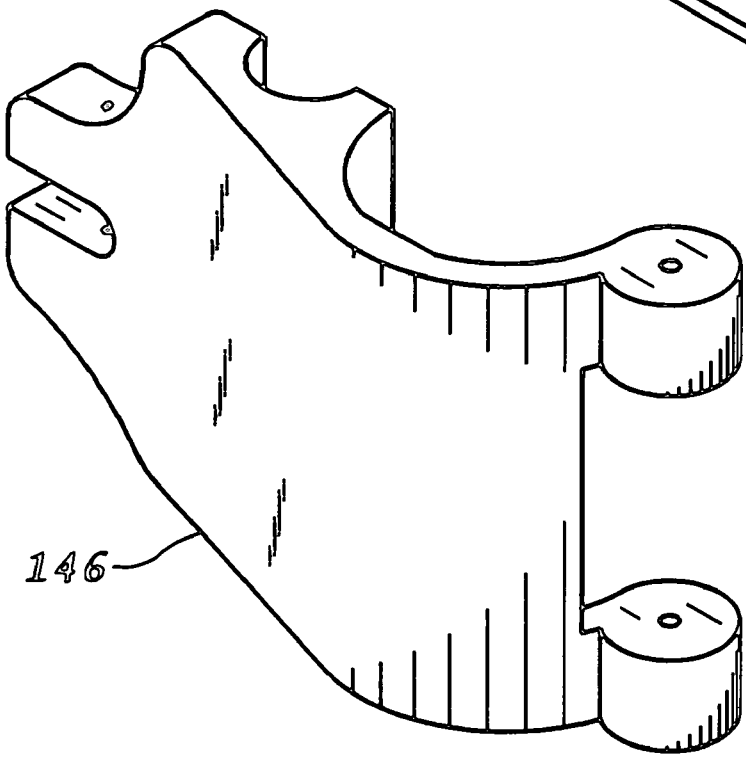
FIG. 10b

FIG. 11a
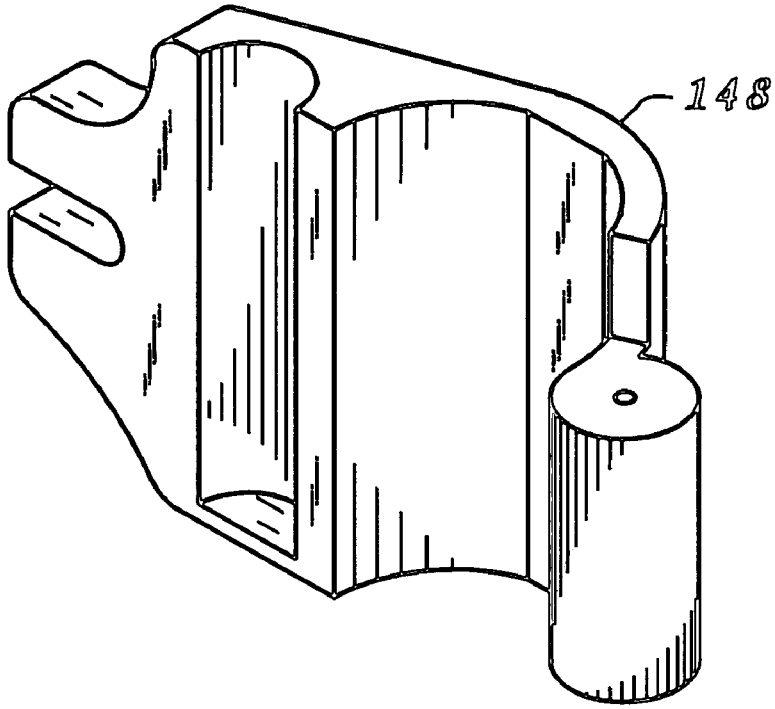
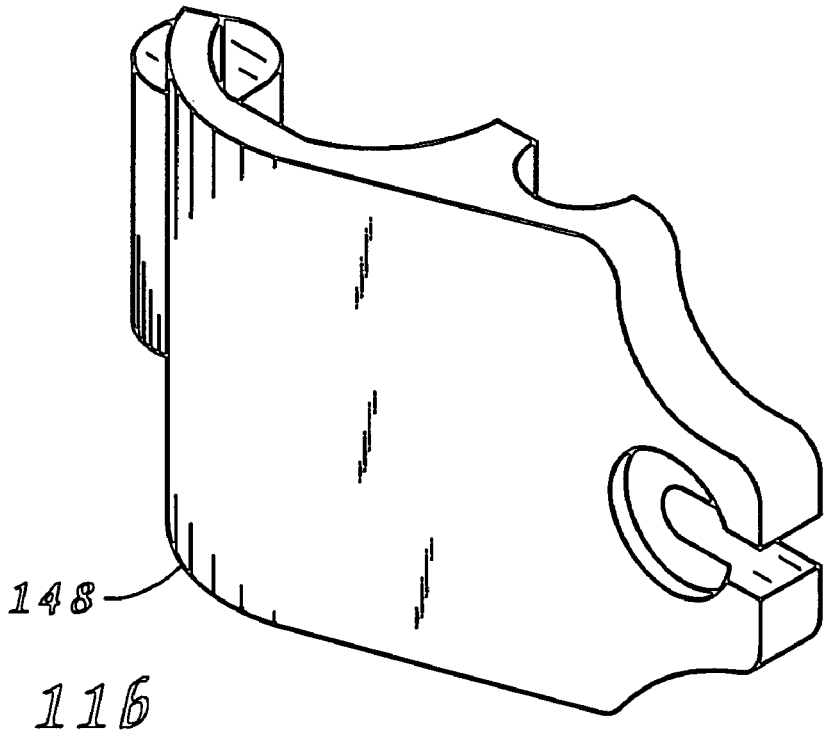
FIG. 11b

FIG. 14
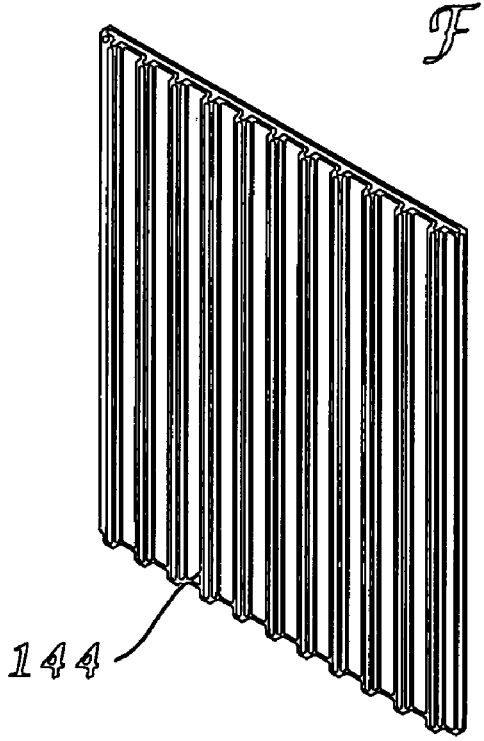
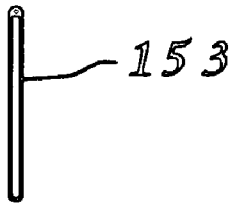
FIG. 15
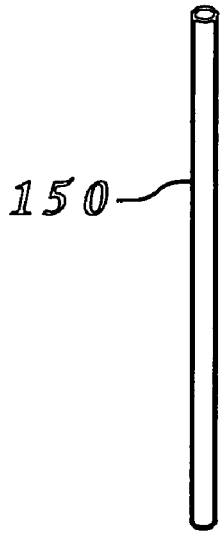
FIG. 16

SWIMMING EXERCISING DEVICE

BACKGROUND

1. Field of the Invention

Generally, the invention relates to exercise devices where the exercise is performed in water. More specifically, the invention relates to such exercise devices which permit a swimmer to be retained in a generally stationary position within a body of water, such as a swimming pool, during performance of a conventional swimming action.

2. Description of the Prior Art

Numerous methods exist to exercise portions of the human body. Certain devices have been proposed which provide for the person performing the associated exercise to be in water. It has long been known that swimming is one of the very best forms of exercise. Many types of 'strokes', or swimming styles, are known in conventional swimming. Some of these utilize movement and exertion of the arms more than that of the legs. Some of these utilize movement and exertion of the legs more than that of the arms. Some of these utilize movement and exertion of both the arms and legs. During swimming, even through the arms and legs may appear to be performing most of the action, many muscles of the body are utilized. Therefore, a full body workout can be obtained by swimming for a reasonable period of time.

Swimming is considered by many in the medical and physical fitness fields as a nearly perfect exercise for nearly all persons regardless of age or general physical condition. Unlike running, or even walking, there is no impact delivered to the feet and legs, including all of the joints contained therein, during swimming. Additionally, many styles of swimming simultaneously exercise both the arms and legs during performance of the respective swimming action. Certain land based exercise routines, such as jumping jacks, exercise both the arms and legs simultaneously but typically such exercises due not provide desirable resistance to the limbs during performance of the exercise. Water is the ideal medium for exercise due to the nature of the water and the natural resistance to motion of objects through water. During swimming the swimmer may merely increase their speed of completing each cycle of a stroke to increase the resistance of the exercise. Additionally, during swimming it is easy to change from one selected style of swimming to another style of swimming to vary the workout routine.

The fundamental problem with swimming as an exercise involves the fact that most Americans which routinely swim as an exercise do so in a swimming pool. Therefore, the swimmer will swim from one end of the pool to the opposing end, then turn one hundred and eighty (180) degrees and swim back to the then opposing end. This cycle will then be performed repetitively for the duration of the exercise routine. This constant contact with, or at least approach to, the hard perimeters of the opposing ends of the pool have obvious inherent dangers. Many swimming styles have the swimmer's face down into the water which is raised out of the water to breath and to look forward, if desired. Other swimming styles have the swimmer's face facing upward toward the sky, such as during performance of the backstroke. For these reasons it is difficult for the swimmer to constantly remain aware of their spacial orientation with the perimeter of the pool that they are approaching during movement from one end to the opposing end. Many swimming pools, particularly those associated with a individual home, are relatively small. Additionally, some swimming styles require a depth of water greater than that of the shallow end of some swimming pools. Often the swimmer desiring to perform their exercise routine in a swimming pool will have other swimmers utilizing the swimming pool for their own recreational use. For all of these reasons many persons having access to a swimming pool will not utilize the pool to the fullest extent possible for exercise.

Applicant previously developed and patented, U.S. Pat. No. 4,530,497 issued Jul. 23, 1985, an exercising device which provides many of the benefits of stationary swimming exercise. Applicant has been successfully marketing products based upon applicant's earlier invention for many years. Applicant has recently made numerous improvements to his product line which are the subject matter of the present invention.

Various deficiencies exist with nearly all forms of exercise and devices to facilitate each respective form of exercise. Applicant's previous invention, and products based upon that invention, provide for the optimal exercise routine in an extremely safe manner. Various minor disadvantages exist with applicant's prior invention and products based upon that invention. These minor disadvantages are particularly related to shipping and distribution of such products and transport and storage of such products by the end user. As such, it may be appreciated that there continues to be a need for a versatile and transportable swimming exercise device. The present invention substantially fulfills these needs.

SUMMARY

In view of the foregoing disadvantages inherent in the known types of exercise devices, your applicant has devised a swimming exercise device for a swimmer to allow generally free movement of legs and arms during performance of a swimming action by the swimmer within a body of water. The performance of the swimming action occurring while the swimmer is being restricted to a generally stationary position in the body of water. The swimming exercise device has a pole, means to retain the pole, an engagement member and a connection member. The pole has a securing end, an outer end and a resilient flexibility along a portion of the pole at least near the outer end. The means to retain the pole providing for the securing end of the pole to be retained in a fixed position relative to the body of water. The engagement member contacts the swimmer while leaving the swimmer free to manipulate their legs and arms during performance of the swimming action. The connection member has a first end and a second end. The first end of the connection member is secured relative to the outer end of the pole. The second end of the connection member is secured relative to the engagement member. This combination of the pole, the engagement member and the connection member cooperate to provide for a restriction of placement of the swimmer in the body of water during the performance of the swimming action while further providing for a lifting action to the swimmer while in the body of water during the performance of the swimming action.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for an exercise device which will retain a swimmer in a swimming pool in a generally stationary placement where the swimmer will exercise utilizing any desired swimming stroke for any desired duration of time.

Other objects include;

a) to provide for a lifting action to be exerted on the generally stationary swimmer where the stationary swimmer has a sensation generally equaling that obtained during movement through the water during conventional swimming.

b) to provide for a flexing of a pole tethering the swimmer where the stationary swimmer does not experience any sudden or unnatural restraining pressure during each stoke of a series of strokes during performance of the swimming action.

c) to provide for the pole of the swimming exercise device to be formed of multiple parts which may be separated where transport of the swimming exercise device may occur in shipping or transport containers which do not have excessive length.

d) to provide for a flush mount which is generally permanently positioned in a surface of a concrete slab adjacent a swimming pool where the pole of the swimming exercise device may be inserted into the flush mount during times when the swimming exercise device will be utilized and removed from the flush mount when the swimming exercise device will not be utilized.

e) to provide for the flush mount to not interfere with routine use of the swimming pool when the swimming exercise device is not being utilized and the pole of the device is not inserted into the flush mount.

f) to provide for the flush mount to securely retain the pole of the swimming exercise device.

g) to provide for a hand rail mount which may be easily and quickly attached and detached from a hand rail of a swimming pool and which does not adversely effect use of the hand rail of the swimming pool when attached thereto.

h) to provide for the hand rail mount to securely retain the pole of the swimming exercise device.

i) to provide for a pole mount assembly which may be utilized with standard above ground pools where the pole mount assembly does not adversely effect use of the above ground pool.

j) to provide for the pole mount assembly for use with above ground pools to securely retain the pole of the swimming exercise device.

k) to provide for a water weighted pole mount container which may be utilized with pools where it is not desirable and/or is not possible to utilize any of the other pole mounting methods.

l) to provide for the water weighted pole mount container to securely retain the pole of the swimming exercise device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 10*a* and FIG. 10*b* are opposing perspective views of a component of a hand rail mount.

FIG. 11*a* and FIG. 11*b* are opposing perspective views of another component of the hand rail mount.

FIG. 14 is a perspective view of an additional component of the hand rail mount.

FIG. 15 is a perspective view of an additional component of the hand rail mount.

FIG. 16 is a perspective view of an additional component of the hand rail mount.

DESCRIPTION

Figure 1:
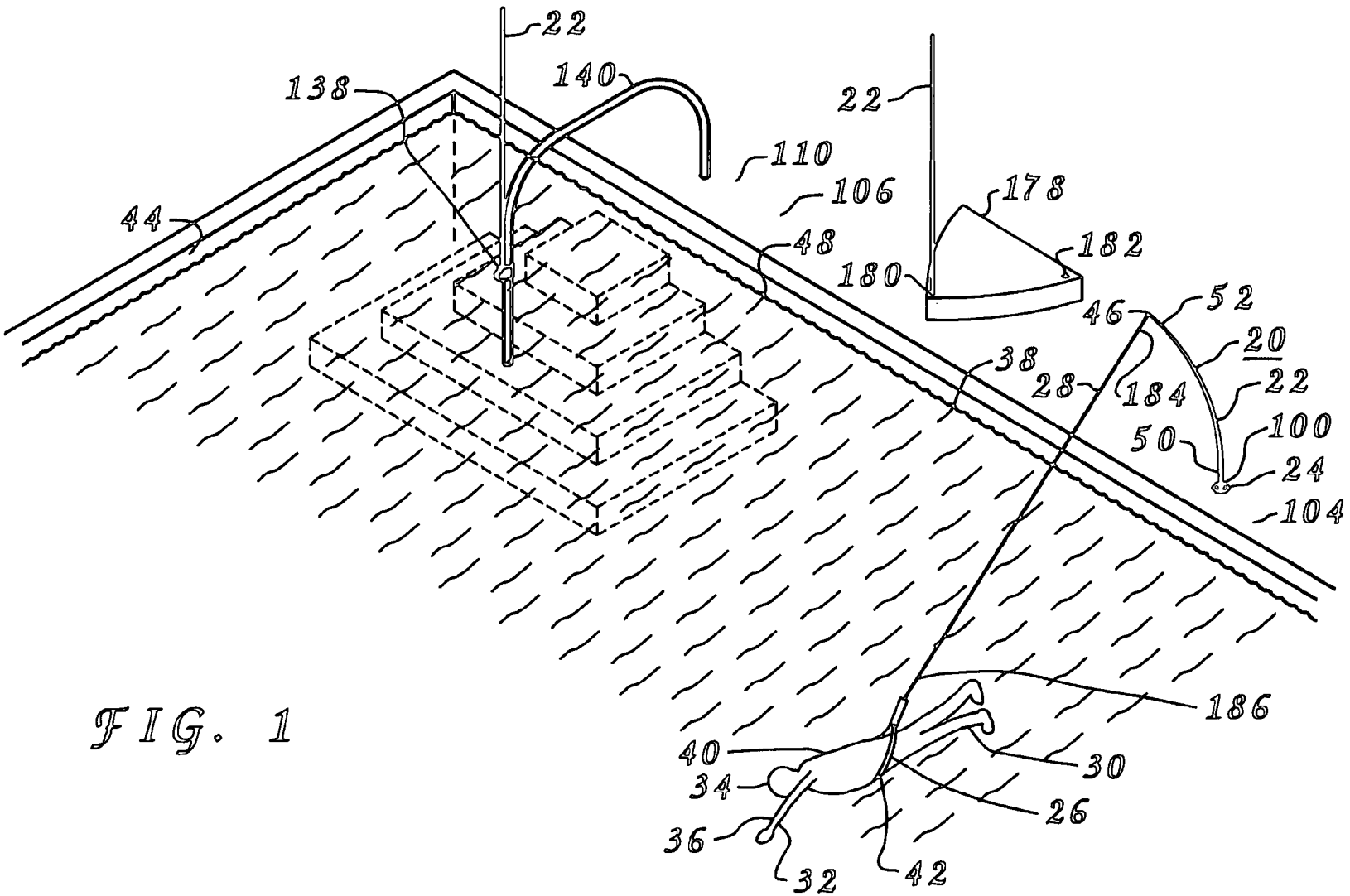
FIG. 1 is a perspective view of a body of water have three (3) swimming exercise devices of the present invention positioned thereabout.
Figure 2:
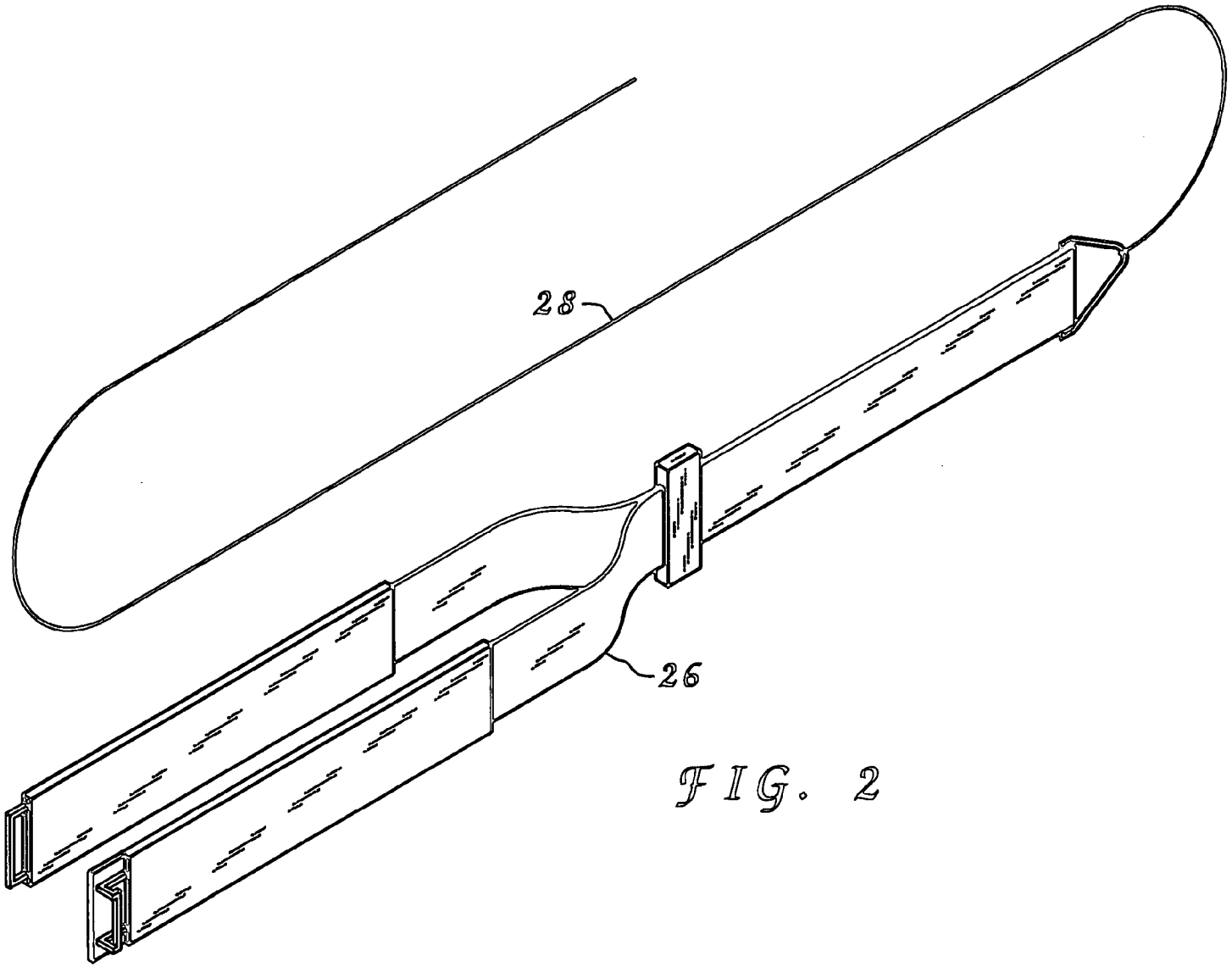
FIG. 2 is a perspective view of an engagement member and a connection member of the swimming exercise device.

Many different systems having features of the present invention are possible. The following description describes the preferred embodiment of select features of those systems and various combinations thereof. These features may be deployed in various combinations to arrive at various desired working configurations of systems.

Reference is hereafter made to the drawings where like reference numerals refer to like parts throughout the various views.

The present invention provides for a person to perform a swimming based exercise in a generally stationary position within a body of water while experiencing all of the benefits of free movement swimming. In order to provide these benefits structural components cooperate to perform various required functions. The required functions include placement restriction, lifting action and resilient motion. Numerous structural arrangements are available to perform each of these functions and may be deployed in various combinations. An anchoring of the pole relative to the body of water, in combination with other structural components, provides for the desired placement restriction of the swimmer within the body of water. The lifting action provides the swimmer with the sensation of free swimming while being retained in a generally fixed location within the body of water. During performance of the swimming action the swimmer will be making the strokes associated with a specific swimming style in a repetitive manner. It being understood that many swimming styles may be utilized with the present invention. During performance of each stroke for any respective swimming style, as is true for conventional free swimming, various degrees of forward force will be applied by the swimmer within the water during a specific point within each of the strokes. During conventional free swimming these variations in propulsion force within each repetitive cycle of strokes would have no noticeable effect upon the swimmer. When the strokes are performed in a tethered manner it is desirable to provide for a certain degree of resilient motion at some location within the tether assembly to maintain a generally uniform pressure between the swimmer and the components of the assembly contacting the swimmer. While this resilient motion may be accommodated within various of the components, or even a combination of components, it has been discovered that the best component to provide this feature is the pole. Additionally, it has been discovered that it is best to restrict this flex of the pole to the uppermost portion of the pole. This is accomplished in the preferred embodiment by providing a taper to the pole, as is conventionally known in fishing poles, where a diminishing of diametric measurement along the length of the pole restricts the flex to the outermost extent of the pole. Of course, if desired, it is possible to provide certain portions of the pole to have a uniform diametric measurement rather than having a taper along the entire length of the pole.

FIG. 1 depicts a swimming exercise device 20 having a pole 22, means to retain pole 22, in the form of a pole mount 24, an engagement member 26 and a connection member 28. Swimming exercise device 20 functions to allow a generally free movement of legs 30 and arms 32 of a swimmer 34 during performance of a swimming action 36 by swimmer 34 within a body of water 38 while swimmer 34 is being restricted to a generally stationary position 40 in body of water 38.

Pole 22, engagement member 26 and connection member 28 cooperate to provide for restriction of placement of swimmer 34 in body of water 38 during performance of swimming action 36 while further providing for a lifting action 42 to swimmer 34 while in body of water 38 during performance of swimming action 36. The combination of location placement with the lifting action provides for an excellent exercise session which is extremely beneficial to overall health yet is both fun to perform and safe to perform.

The present invention provides for swimmer 34 to be retained in stationary position 40 within body of water 38, such as a swimming pool 44, while also providing a certain amount of lift within swimming pool 44 during performance of swimming action 36. To this end of providing for the retention in stationary position 40 pole 22 provides for securement to a fixed position relative to body of water 38. Pole 22 also provides for a certain amount of resilient motion, or flex, which is providing the resistance to swimmer 34 during performance of swimming action 36. To the end of providing the lift during performance of the swimming action it is necessary to provide for elevation of a connection point 46 of pole 22 for connection member 28 above a surface 48 of swimming pool 44.

A pole will be provided which will perform several important functions. The pole will provide for an attachment location for the connection member elevated well above the surface of the body of water. This elevated attachment location in combination with an angle of the connection member will provide the desired lifting action to the swimmer during performance of the swimming action. Additionally, a resilient flexibility of the pole will provide for resilient motion of swimmer 34 within swimming pool 44. Pole has a securing end 50, an outer end 52 and a resilient flexibility along a portion of pole 22 at least near outer end 52. Preferably, pole 22 has a gradual and consistent taper, as depicted, from securing end 50 to outer end 52. Pole 22 may be constructed from many suitable materials.

Figure 3A:
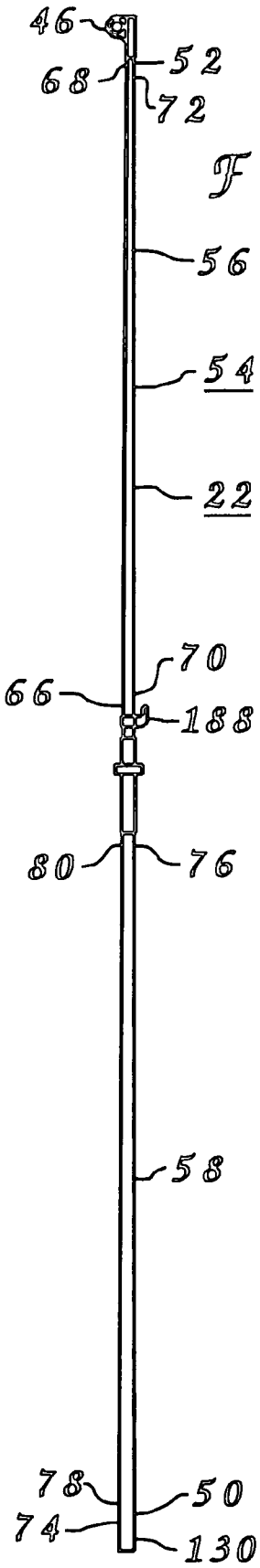
FIG. 3*a* and FIG. 3*b* are elevational views of a pole of the swimming exercise device in an assembled state and a disassembled state.
Figure 3B:
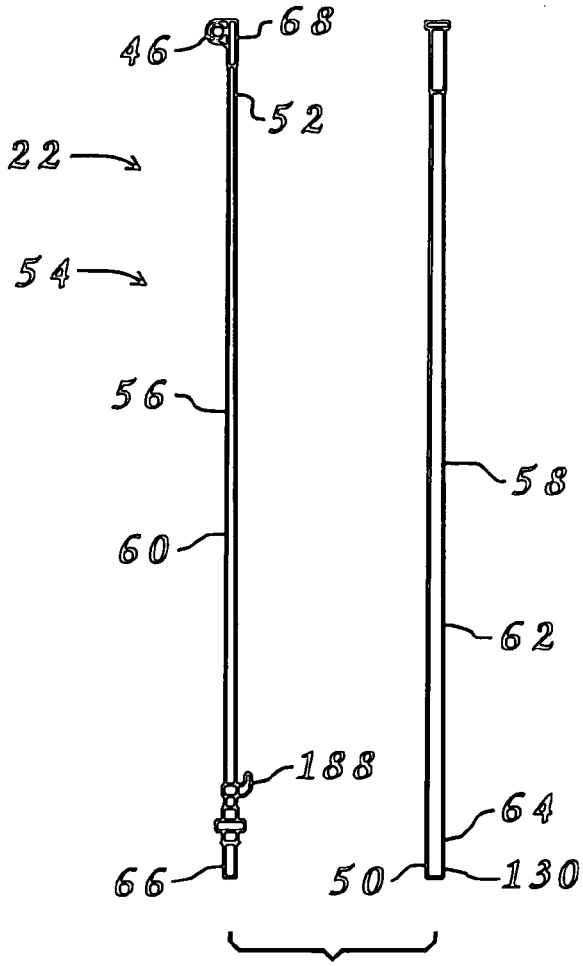
Figure 4A:
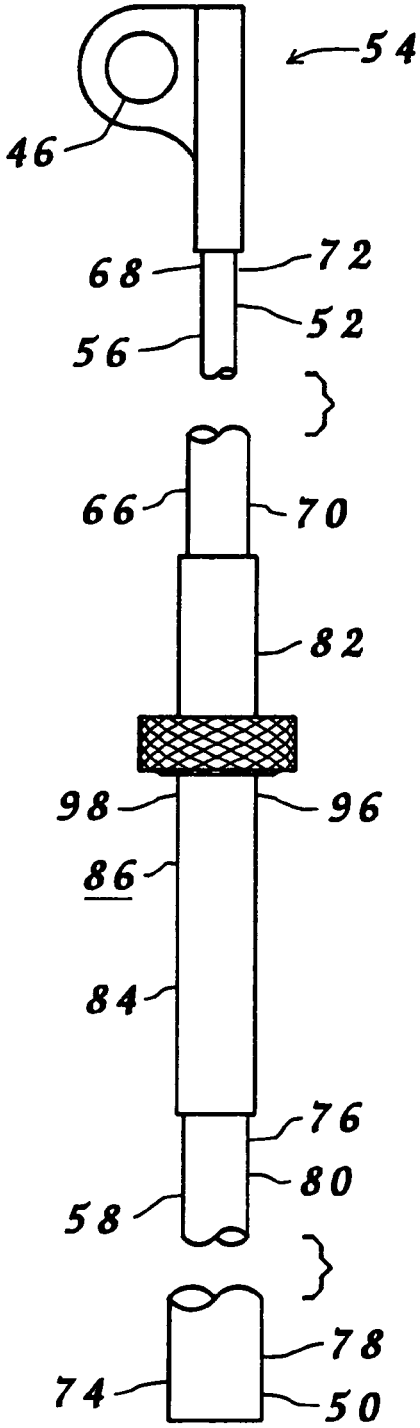
FIG. 4*a* and FIG. 4*b* are elevational view of enlarged portions of the components depicted in FIG. 3*a* and FIG. 3*b*.
Figure 4B:
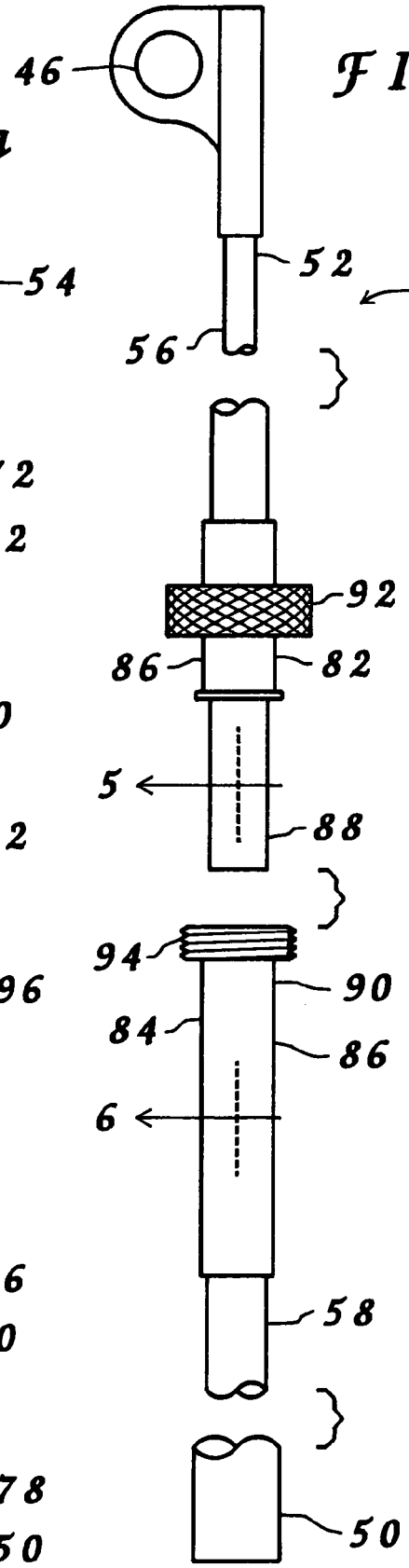
Figure 5:
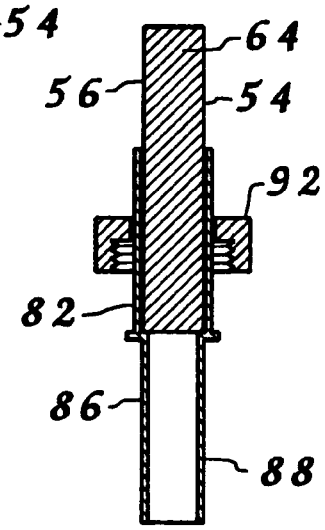
FIG. 5 is a sectional view of a portion of the assembly depicted in FIG. 4*b* as taken from the section line '5' shown in FIG. 4*b*.
Figure 6:
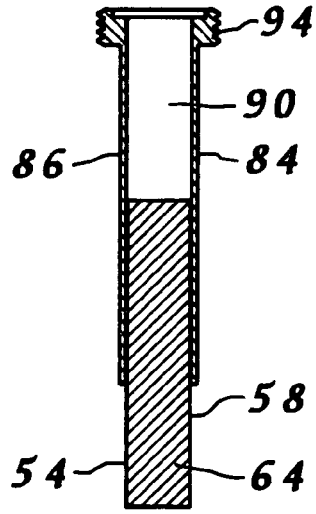
FIG. 6 is a sectional view of a portion of the assembly depicted in FIG. 4*b* as taken from the section line '6' shown in FIG. 4*b*.
Figure 7A:
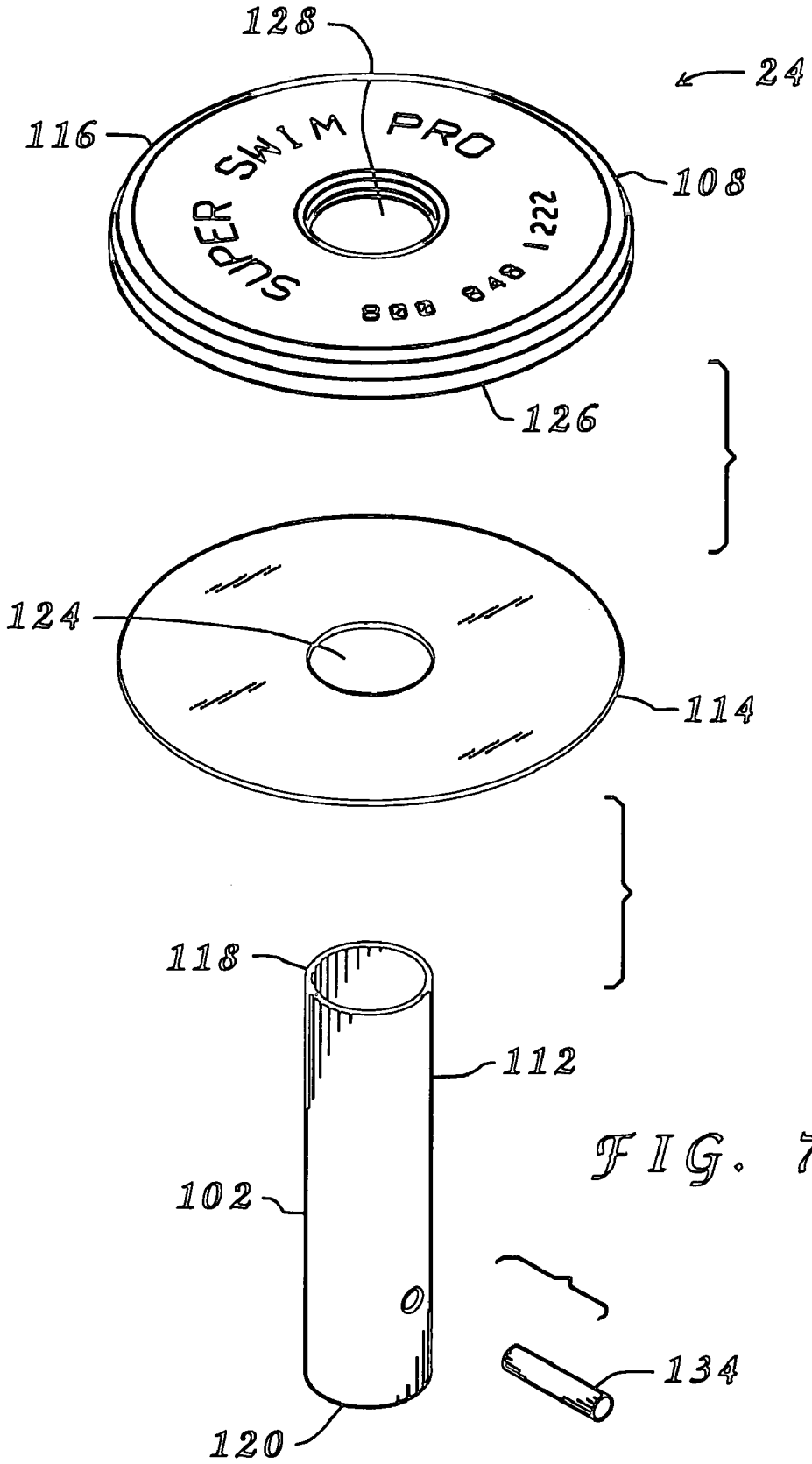
FIG. 7*a* and FIG. 7*b* are opposing exploded perspective views of the components of a pole mount.
Figure 7B:
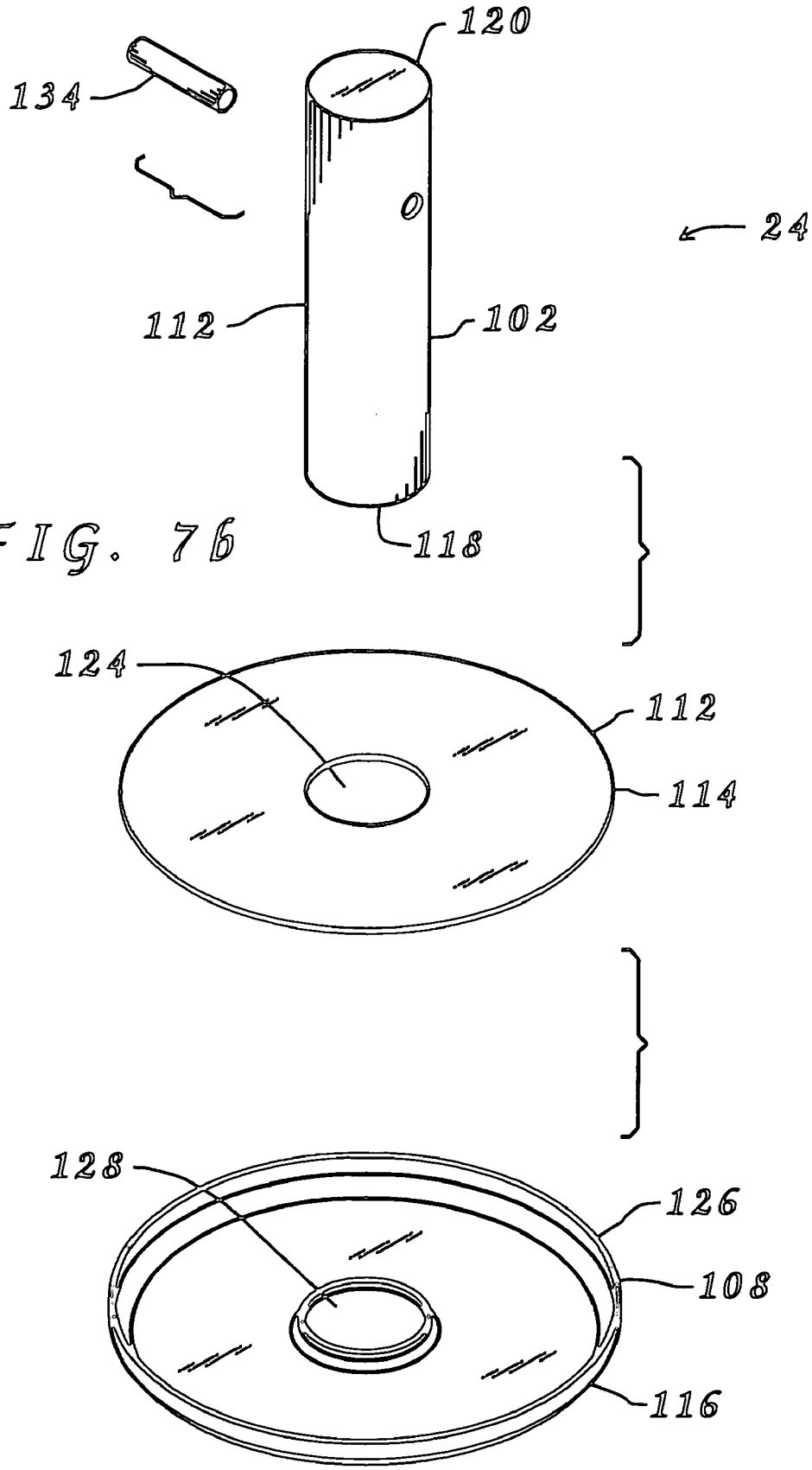
Figure 8A:
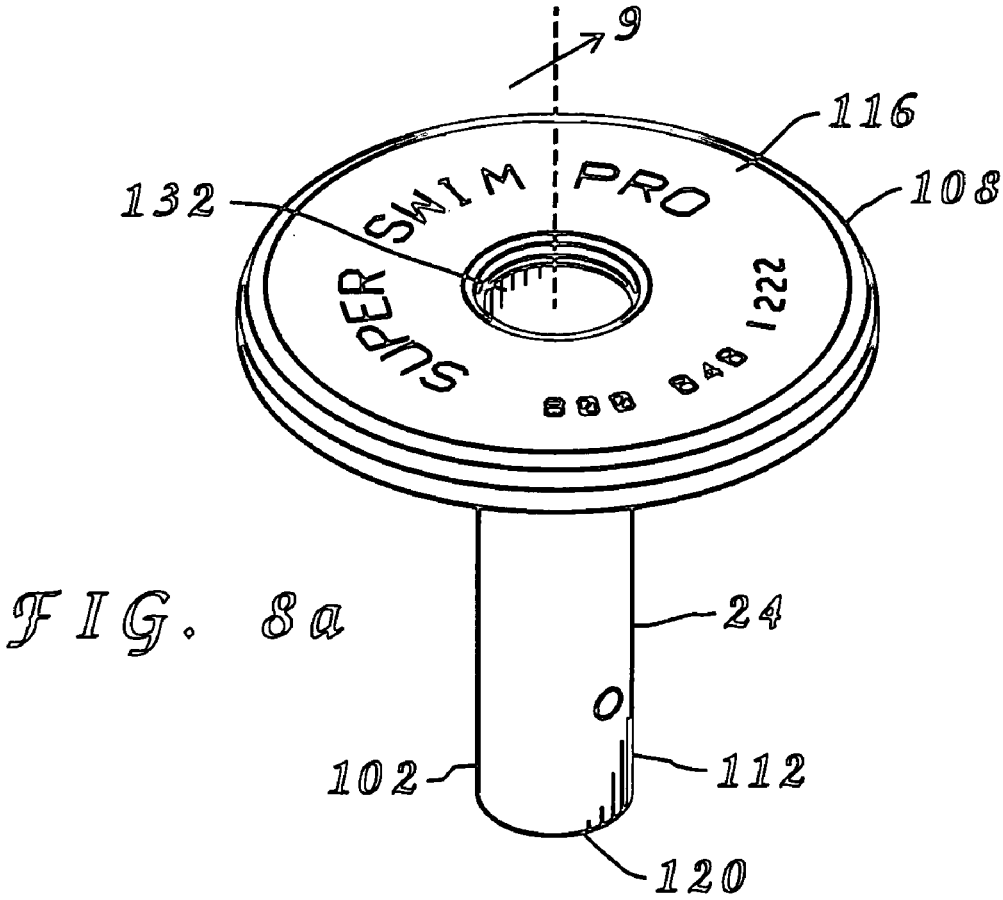
FIG. 8*a* and FIG. 8*b* are opposing perspective views of the pole mount following assembly from the components depicted in FIG. 7*a* and FIG. 7*b*.
Figure 8B:
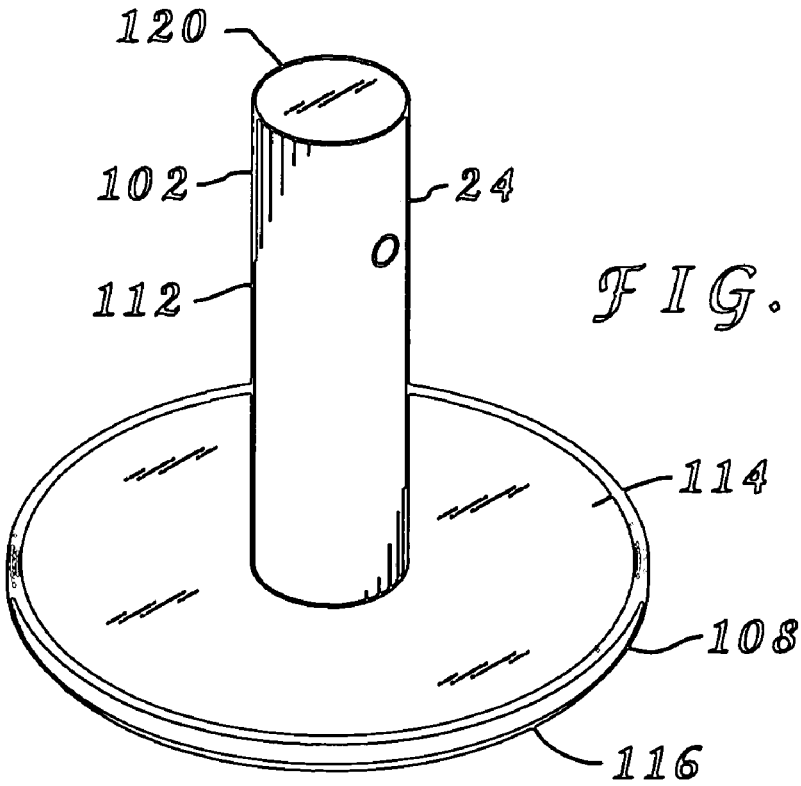

Pole 22 preferably is provided in the form of a multiple part pole 54, see FIG. 3*a* through FIG. 6, having at least two (2) portions which may be easily separated, see FIG. 3*a* and FIG. 4*b*, and easily attached, see FIG. 3*a* and FIG. 4*a*. Multiple part pole 54 has a first portion 56 and a second portion 58. First portion 56 of multiple part pole 54 has a length measurement 60, see FIG. 3*b*, while second portion 58 of multiple part pole 54 has a length measurement 62, also see FIG. 3*b*. In the most preferred embodiment length measurement 60 of first portion 56 is generally equal to length measurement 62 of second portion 58. In a preferred embodiment first portion 56 is formed of a solid shaft material 64, see FIG. 5, and second portion 58 is formed of solid shaft material 64, see FIG. 6.

Referring now to FIG. 3*a* and FIG. 4*a* which depict a preferred embodiment, first portion 56 of multiple part pole 54 has a first end 66 and a second end 68. First end 66 of first portion 56 has a diametric measurement 70. Second end 68 of first portion 56 has a diametric measurement 72. Diametric measurement 70 of first end 66 of first portion 56 is greater than diametric measurement 72 of second end 68 of first portion 56. Second portion 58 of multiple part pole 54 has a first end 74 and a second end 76. First end 74 of second portion 58 has a diametric measurement 78. Second end 76 of second portion 58 has a diametric measurement 80. Diametric measurement 78 of first end 74 of second portion 58 is greater than diametric measurement 80 of second end 76 of second portion 58. Diametric measurement 70 of first end 66 of first portion 56 is generally equal to diametric measurement 80 of second end 76 of second portion 58.

When multiple parts are provided for the pole it is necessary to assemble and secure the various parts. Many coupling and securing methods are known in the art to provide this required function and many of these methods and structures may be utilized with the present invention.

FIG. 3*a* through FIG. 6 depict a preferred embodiment for this coupling and securing where first portion 56 of multiple part pole 54 has a pole coupling end 82 and second portion 58 of multiple part pole 54 has a pole coupling end 84. Multiple part pole 54 has a penetrate and secure coupling 86 having a male member 88, a female member 90, a first threaded member 92 and a second threaded member 94. Pole coupling end 82 of first portion 56 and pole coupling end 84 of second portion 58 slidably join utilizing male member 88 of penetrate and secure coupling 86 and female member 90 of penetrate and secure coupling 86 and are securely retained utilizing first threaded member 92 of penetrate and secure coupling 86 and second threaded member 94 of penetrate and secure coupling 86. Pole coupling end 82 of first portion 56 and pole coupling end 84 of second portion 58 are retained in an extremely close orientation 96 when penetrate and secure coupling 86 is in a secured orientation 98.

It is a requirement that some arrangement be provided to retain the securing end of the pole relative to the body of water. This may be provided by merely utilizing existing structures about the body of water or, more preferably, will involve providing dedicated structural components which will be fixedly secured, at least temporarily, about the body of water.

It is possible to provide for at least the pole of the present invention to remain generally permanently positioned relative to the body of water even when not being utilized for performance of the swimming action. More preferably, the pole will be removed when not being utilized for performance of the swimming action. To this end it is desirable that the pole be slidably insertable and removeable relative to a pole mount. Many variations of pole mounts are possible with various embodiments depicted in the various views.

FIG. 1 and FIG. 7*a* through FIG. 9 depict pole mount 24 as the means to retain securing end 50 of pole 22 in a fixed position 100 relative to body of water 38. Pole mount 24 has a portion 102 which penetrates concrete 104 of concrete pad 106 subsequent to an installation of pole mount 24. Pole mount 24 has a portion 108 which extends slightly above a surface 110 of concrete 104 of concrete pad 106 subsequent to the installation of pole mount 24. Pole mount 24 has a tube portion 112, a planar panel portion 114 and a bowl panel portion 116. Tube portion 112 has an upper end 118 and a lower end 120 subsequent to installation of pole mount 24 relative to concrete pad 106. Planar panel portion 114 has an outer perimeter edge 122 and an aperture 124 therethrough. Bowl panel portion 116 has an outer perimeter edge 126 and an aperture 128 therethrough. Tube portion 112 slidably receives a portion 130, see FIG. 3*a* and FIG. 3*b*, of securing end 50 of pole 22 of swimming exercise device 20 during performance of swimming action. Pole mount 24 has an opening 132 to receive pole 22. A spanning member 134 extends across tube portion 112, see FIG. 9, spaced slightly from lower end 120 but in close proximity to lower end 120. Spanning member 134 contacts pole 22 when inserted in pole mount 24 where pole 22 may not contact lower end 120 of tube portion 112. This arrangement prevents damage to lower end 120 of tube portion 112 by pole 22.

Figure 9:
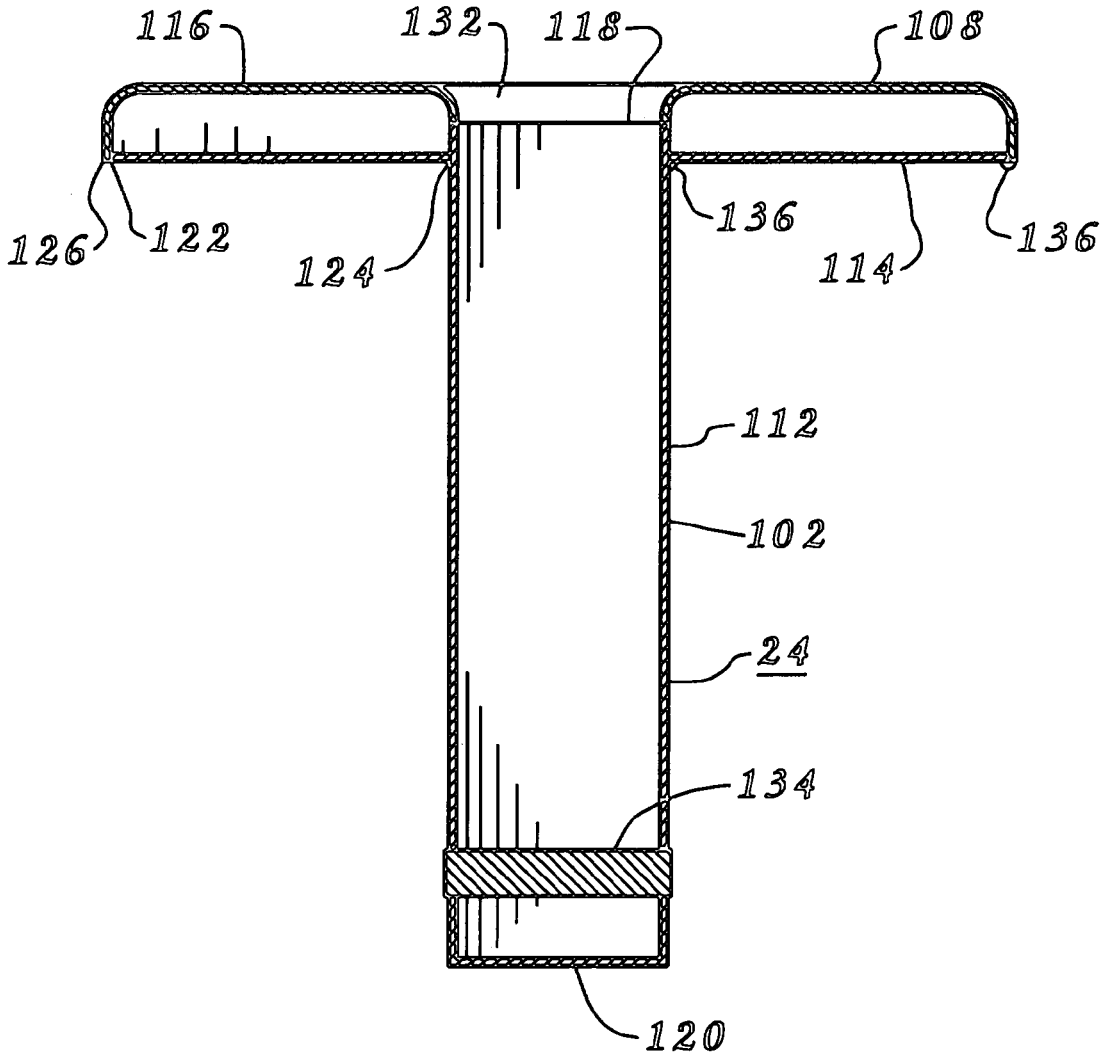
FIG. 9 is a sectional view of the pole mount as taken from the section line '9' shown in FIG. 8*a*.
Figure 12A:
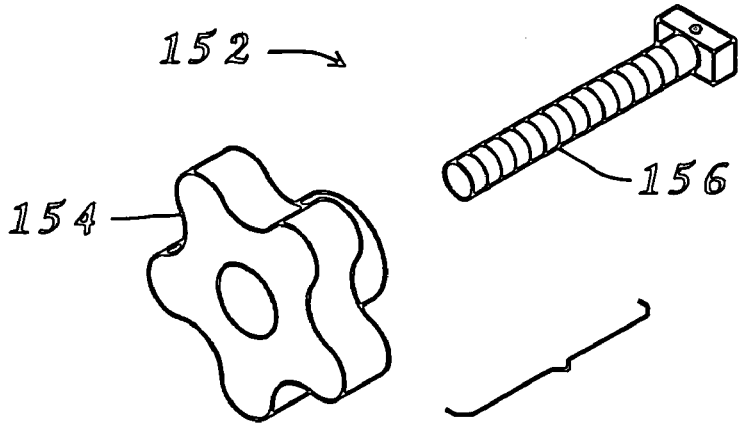
FIG. 12*a* and FIG. 12*b* are opposing perspective views of additional components of the hand rail mount and depicted in a detached arrangement.
Figure 12B:
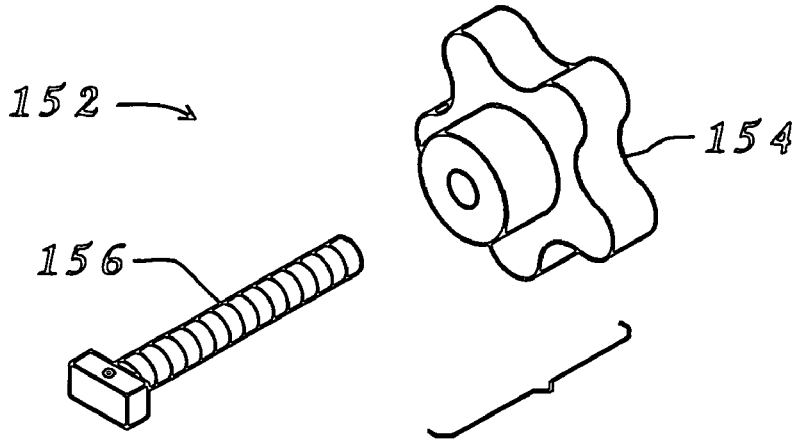
Figure 13:
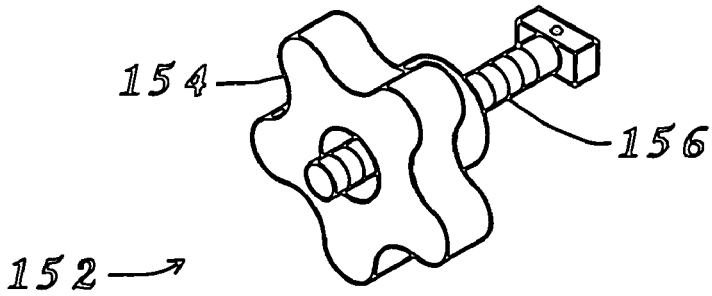
FIG. 13 is a perspective view of the components depicted in FIG. 12*a* and FIG. 12*b* in an assembled arrangement.

Referring now to FIG. 9, pole mount 24 is constructed where tube portion 112 penetrates aperture 124 of planar panel portion 114 and is secured thereat utilizing any suitable securement method, such as welds 136. Upper end 118 of tube portion 112 is positioned in close proximity to aperture 128 of bowl panel portion 116 and is secured thereat utilizing any suitable securement method, such as welds 136. Outer perimeter edge 126 of bowl panel portion 116 is in close proximity to outer perimeter edge 122 of planar panel portion 114 and is secured thereat utilizing any suitable securement method, such as welds 136.

FIG. 1 depicts a hand rail mount 138 which may easily be installed on, and which may easily be removed from, a hand rail 140 associated with swimming pool 44. Hand rail mount 138 completely surrounds hand rail 140 subsequent to installation of hand rail mount 138 and securely is retained at the point of installation for subsequent retention of other components of the present invention.

Figure 17A:
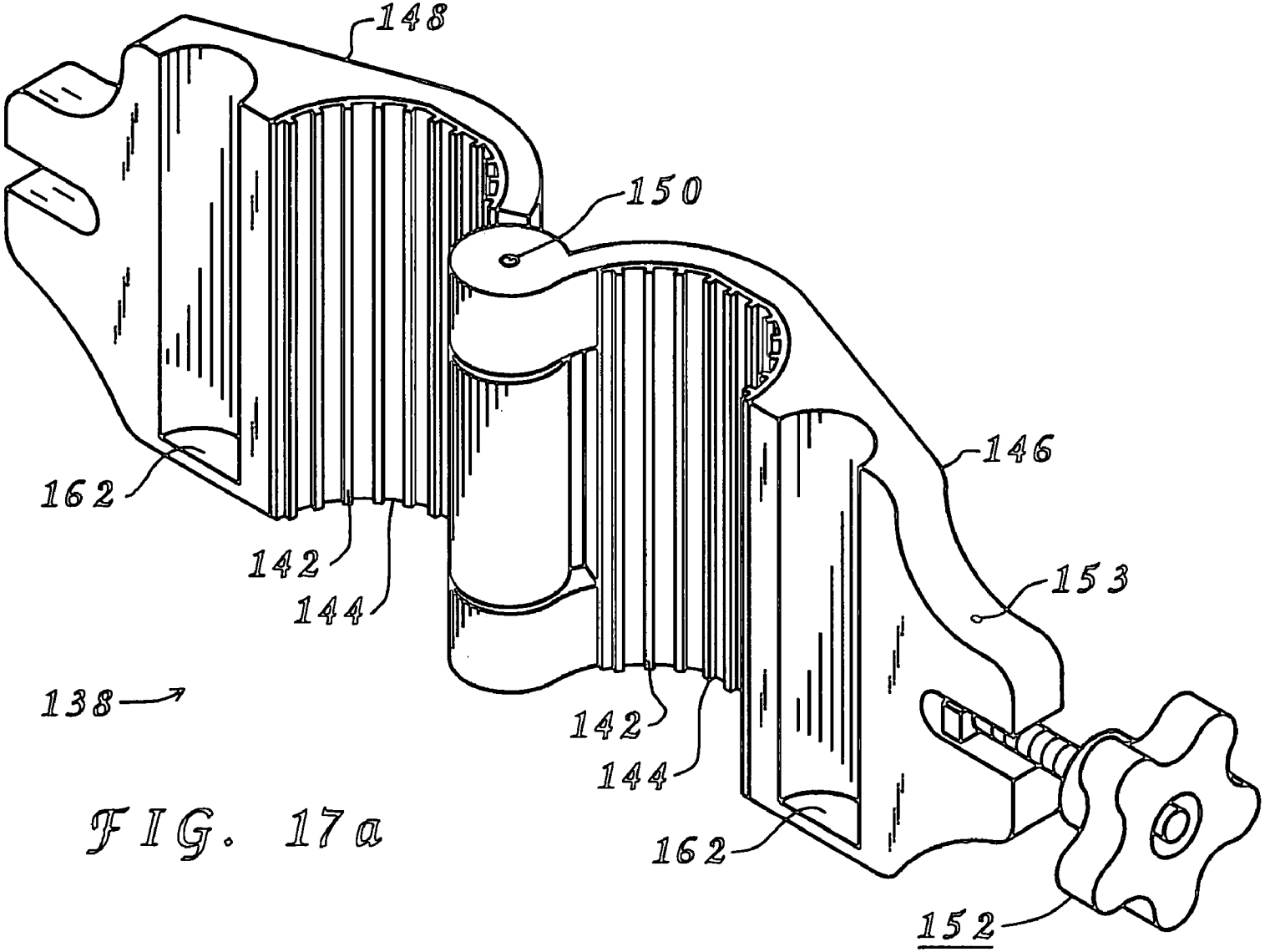
FIG. 17*a* through FIG. 17*d* are perspective views of the hand rail mount subsequent to assembly and depicted in various operational orientations.
Figure 17B:
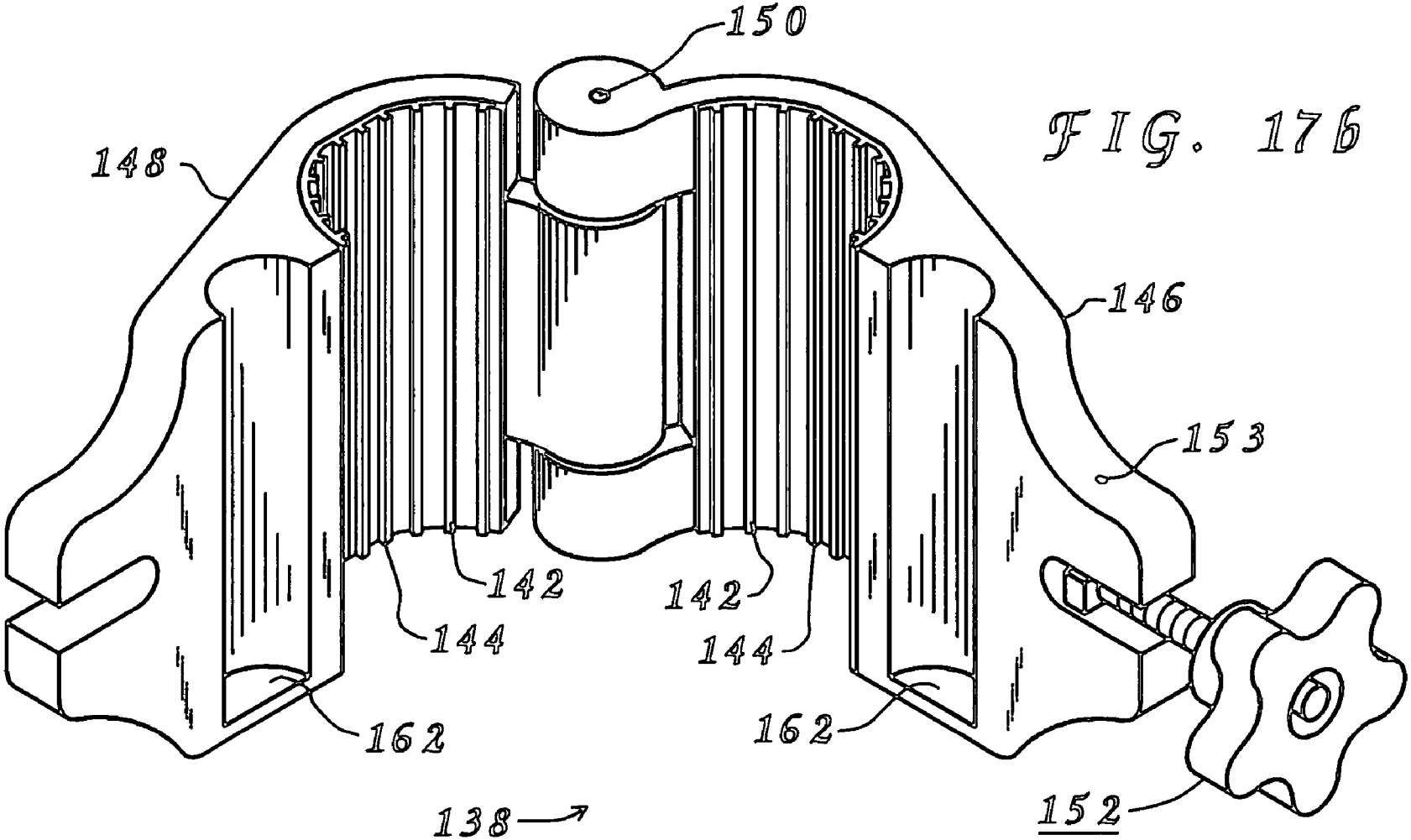
Figure 17C:
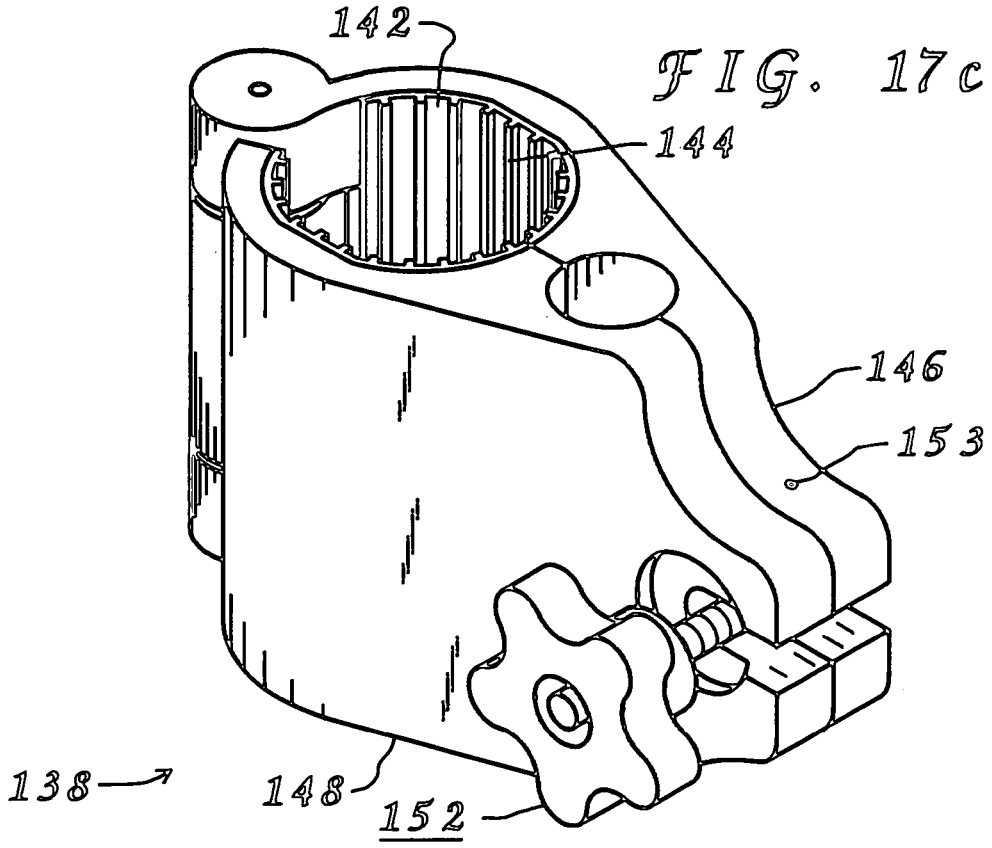
Figure 17D:
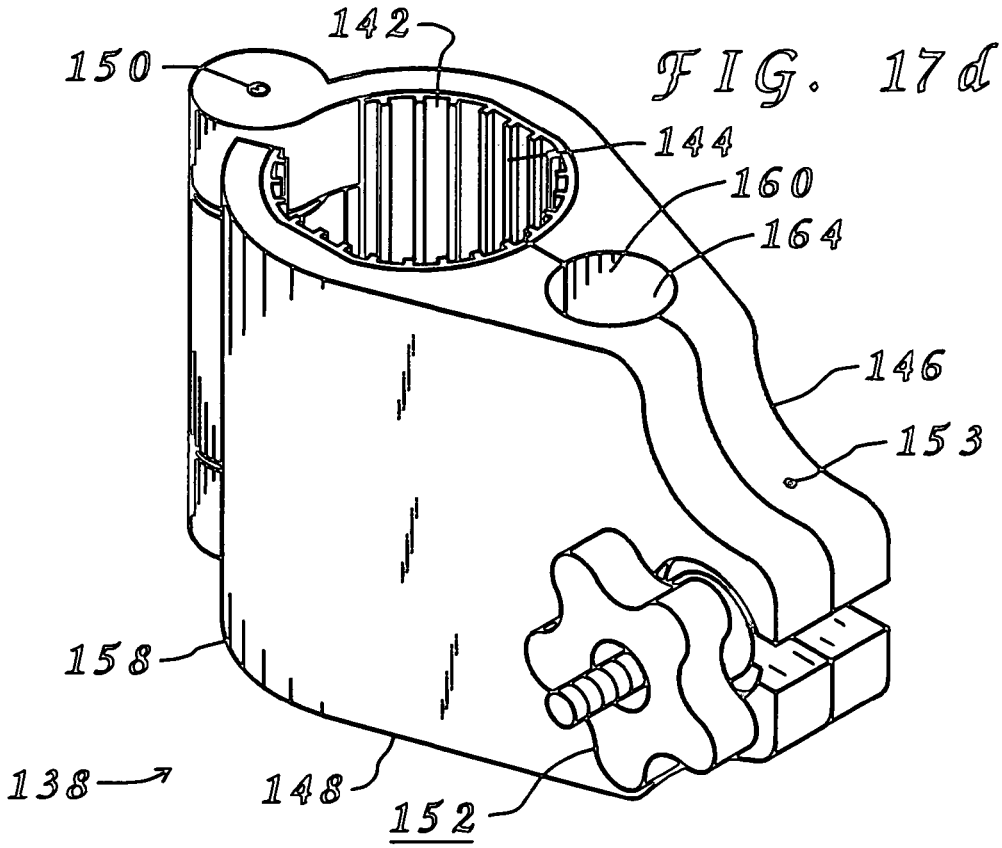

Referring now to FIG. 1 and FIG. 10*a* through FIG. 17*d*, hand rail mount 138 has a hand rail contact surface 142 which makes contact with hand rail 140 subsequent to installation. Hand rail contact surface 142 of hand rail mount 138 is formed of opposing pieces of a compressible resilient material 144, see FIG. 14. Hand rail mount 138 has a first body member 146, a second body member 148 and a hinge member 150. First body member 146 and second body member 148 are attached to hinge member 150. This provides for first body member 146 and second body member 148 to pivot relative to each other at hinge member 150 to provide for placement over hand rail 140 during installation of hand rail mount 138 and to provide for removal from hand rail 140. A pivotal threaded anchor 152 is pivotally attached to first body member 146 utilizing a securing pin 153. Pivotal threaded anchor 152 has a threaded coupling member 154 and a threaded portion 156. Threaded coupling member 154 is selectively displaceable along threaded portion 156 to provide for pressure bearing contact of pivotal threaded anchor 152 with second body member 148 utilizing manipulation of threaded coupling member 154 for movement along threaded portion 156 of pivotal threaded anchor 152. This pressure bearing contact, see FIG. 17*d*, provides for first body member 146 and second body member 148 to be retained in contact with any desired locational position on hand rail 140.

Hand rail mount 138 has an installed orientation 158, see FIG. 17*d*, where a pole penetration recess 160 is positioned thereon while hand rail mount 138 is in installed orientation 158. Pole penetration recess 160 has a generally closed bottom 162 while hand rail mount 138 is in installed orientation 158. Pole penetration recess 160 slidably receives portion 130 of securing end 50 of pole 22 during performance of the swimming action. Pole penetration recess 160 has an outer perimeter 164 along a depth while in installed orientation 158 with outer perimeter 164 of pole penetration recess 160 generally symmetrically disposed on first body member 146 and second body member 148.

Figure 18:
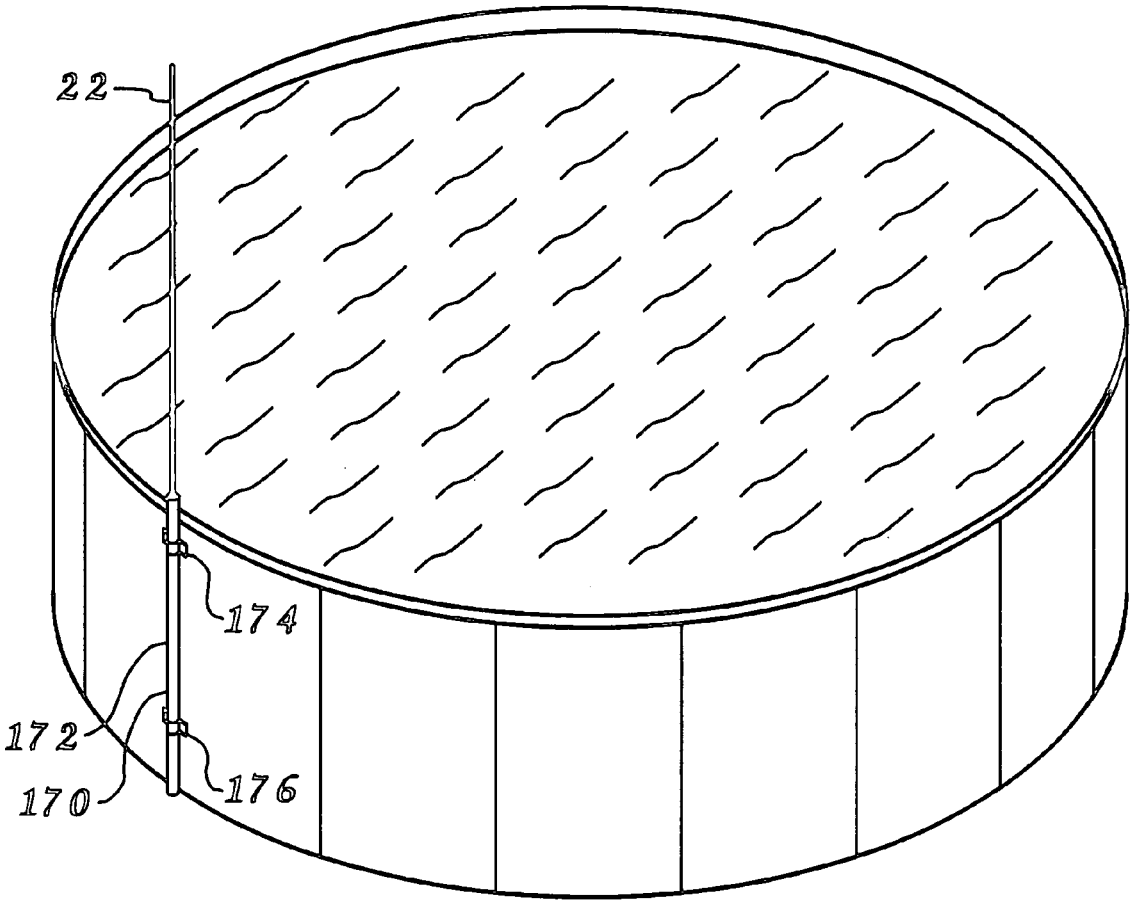
FIG. 18 is a perspective view of an above ground swimming pool with a suitable embodiment of the swimming exercise device positioned thereabout.

FIG. 18 depicts an above ground pool pole mount 170 capable of being installed with above ground pools. Above ground pool pole mount 170 has a pole receiving portion 172 of sufficient length to span from the ground to at least the top of the side of the above ground pool. An upper anchor 174 and a lower anchor 176 provide for securement of pole receiving portion 172 relative to a structural brace of the above ground pool. In the most preferred embodiment of above ground pool pole mount 170 pole receiving portion 172 significantly penetrates the ground adjacent the above ground pool to provide additional structural support.

Numerous variations in construction exist for above ground pools. It is possible to provide the benefits of the present invention to all of these structural configurations. Many of these types of pools have a plurality of structural supports extending upward from ground level to an upper perimeter structural member. These structural supports will reinforce the upper perimeter structural member. Many of these structural supports extend generally vertical and have a uniform cross section profile along a significant portion of the support. Certain designs utilize structural supports which expand during elevational travel and/or which are offset from vertical. It is possible to provide for engagement of a select structural support to anchor the pole of the present invention. This engagement may also engage other structures of the above ground pool. It is possible to provide a detachable pole mount which surrounds the structural support and has features to prevent elevational displacement along the structural support and to prevent axial displacement about the structural support. While such mounts may be designed for relatively permanent attachment it is desirable to provide for the mount to be removable such as for the hand rail mount disclosed herein.

FIG. 1 depicts a water weight pole mount 178 having a pole mount recess 180, an interior to contain water and an access passageway 182 to permit filling and draining of water weight pole mount 178 with water. Water weight pole mount 178, when generally filled with water, will securely retain pole 22 within pole mount recess 180. Pole 22 may be removed from water weight pole mount 178 when not being utilized with the present invention.

An engagement member will be provided to contact the swimmer while leaving the swimmer free to manipulate their legs and arms during performance of the swimming action. This may involve mere surrounding contact of the torso of the swimmer, as depicted in FIG. 1 by engagement member 26, or may involve a more elaborate harness type system. In the preferred embodiment depicted engagement member 26 is of a sufficient width and is padded for comfort during performance of the swimming action.

A connection member will be provided to connect the engagement member contacting and retaining the swimmer to the pole. Various structural components may be utilized to perform this function. FIG. 1 depict connection member 28 having a first end 184 and a second end 186 with first end 184 secured relative to outer end 52 of pole 22 and second end 186 secured relative to engagement member 26. It is possible to provide for the connection member to be of a construction to have an elastic property to provide the resilient motion function of the present invention. In the preferred embodiment depicted connection member 28 is merely a conventional nylon strand braided cord.

An engagement member hanging hook member 188, see FIG. 3*a* and FIG. 3*b*, is positioned on pole 22 for hanging placement thereon of engagement member 26 of swimming exercise device 20 when not being utilized during performance of the swimming action. This arrangement provides for an orderly placement of the various components which prevents damage from being inflicted to any of the components while permitting full drying of the components, including engagement member 26 and connection member 28, following use.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A swimming exercise device for a swimmer to allow generally free movement of legs and arms during performance of a swimming action by the swimmer within a body of water while the swimmer is being restricted to a generally stationary position in the body of water, the swimming exercise device comprising:

a) a multiple part pole having a securing end, an outer end and a resilient flexibility along a portion of the multiple part pole at least near the outer end and wherein the multiple part pole further comprises a solid shaft first portion and a solid shaft second portion, and wherein the first portion of the multiple part pole has a first end and a second end and wherein the first end of the first portion of the multiple part pole has a diametric measurement and wherein the second end of the first portion of the multiple part pole has a diametric measurement and wherein the diametric measurement of the first end of the first portion of the multiple part pole is greater than the diametric measurement of the second end of the first portion of the multiple part pole and wherein the second portion of the multiple part pole has a first end and a second end and wherein the first end of the second portion of the multiple part pole has a diametric measurement and wherein the second end of the second portion of the multiple part pole has a diametric measurement and wherein the diametric measurement of the first end of the second portion of the multiple part pole is greater than the diametric measurement of the second end of the second portion of the multiple part pole and wherein the diametric measurement of the first end of the first portion of the multiple part pole is generally equal to the diametric measurement of the second end of the second portion of the multiple part pole;

b) means to retain the securing end of the multiple part pole in a fixed position relative to the body of water;

c) an engagement member to contact the swimmer while leaving the swimmer free to manipulate their legs and arms during performance of the swimming action;

d) a connection member having a first end and a second end with the first end secured relative to the outer end of the multiple part pole and the second end secured relative to the engagement member;

wherein the first portion of the multiple part pole has a pole coupling end, the second portion of the multiple part pole has a pole coupling end and the multiple part pole further comprises a penetrate and secure coupling having a male member, a female member, a first threaded member and a second threaded member wherein the pole coupling end of the first portion and the pole coupling end of the second portion slidably join together when the male member of the penetrate and secure coupling and the female member of the penetrate and secure coupling are securely joined utilizing the first threaded member of the penetrate and secure coupling being secured to the second threaded member of the penetrate and secure coupling such that the pole coupling ends of both the first and second portions of the multiple part pole are in extremely close orientation when the penetrate and secure coupling is in a secured orientation; and wherein the multiple part pole, the engagement member and the connection member cooperate to provide for a restriction of placement of the swimmer in the body of water during the performance of the swimming action while further providing for a lifting action to the swimmer while in the body of water during the performance of the swimming action.

2. The swimming exercise device defined in claim 1 wherein the first portion of the multiple part pole has a length measurement and wherein the second portion of the multiple part pole has a length measurement and wherein the length measurement of the first portion of the multiple part pole is generally equal to the length measurement of the second portion of the multiple part pole.

3. The swimming exercise device defined in claim 1 further comprising an engagement member hanging hook member positioned on the multiple part pole for hanging placement thereon of the engagement member of the swimming exercise device when not being utilized during the performance of the swimming action.

4. A swimming exercise device for a swimmer to allow generally free movement of legs and arms during performance of a swimming action by the swimmer within a body of water while the swimmer is being restricted to a generally stationary position in the body of water, the swimming exercise device comprising:

a) a pole having a securing end, an outer end and a resilient flexibility along a portion of the pole at least near the outer end;

b) means to retain the securing end of the pole relative to a hand rail associated with the body of water, the means to retain comprising a hand rail mount having an installed orientation and a pole penetration recess positioned thereon while the hand rail mount is in the installed orientation, the pole penetration recess having a generally closed bottom while the hand rail mount is in the installed orientation, the pole penetration recess to slidably receive a portion of the securing end of the pole of the swimming exercise device during the performance of the swimming action, the hand rail mount further comprising a hinge member, a first body member attached to the hinge member and a second body member attached to the hinge member wherein the first body member and the second body member pivot relative to each other at the hinge member to provide for placement over the hand rail associated with the body of water during an installation of the hand rail mount and wherein the pole penetration recess has an outer perimeter along a depth while in the installed orientation and wherein the outer perimeter of the pole penetration recess is generally symmetrically disposed on the first body member and the second body member;

c) an engagement member to contact the swimmer while leaving the swimmer free to manipulate their legs and arms during performance of the swimming action;

d) a connection member having a first end and a second end with the first end secured relative to the outer end of the pole and the second end secured relative to the engagement member;

wherein the pole, the engagement member and the connection member cooperate to provide for a restriction of placement of the swimmer in the body of water during the performance of the swimming action while further providing for a lifting action to the swimmer while in the body of water during the performance of the swimming action.

5. The swimming exercise device defined in claim 4 wherein the hand rail mount completely surrounds the hand rail associated with the body of water subsequent to an installation of the hand rail mount.

6. The swimming exercise device defined in claim 4 wherein the hand rail mount has a hand rail contact surface which makes contact with the hand rail associated with the body of water subsequent to an installation of the hand rail mount and wherein the hand rail contact surface of the hand rail mount further comprises a compressible resilient material.

7. The swimming exercise device defined in claim 4 wherein the hand rail mount further comprises a hinge member, a first body member attached to the hinge member and a second body member attached to the hinge member wherein the first body member and the second body member pivot relative to each other at the hinge member to provide for placement over the hand rail associated with the body of water during an installation of the hand rail mount.

8. The swimming exercise device defined in claim 7 wherein the hand rail mount further comprises a pivotal threaded anchor and threaded coupling member, the pivotal threaded anchor pivotally attached to the first body member and securable relative to the second body member utilizing manipulation of the threaded coupling member for movement along a threaded portion of the pivotal threaded anchor.

* * * * *